US007317284B2

(12) United States Patent
Carley

(10) Patent No.: US 7,317,284 B2
(45) Date of Patent: Jan. 8, 2008

(54) SPACER BEAD GEOMETRY FOR CONTROLLED SEALING STABILITY

(76) Inventor: James A. Carley, 2900 Palos Verdes Dr. North, Rolling Hills, CA (US) 90274

( * ) Notice: Subject to any disclaimer, the term of this patent is extended or adjusted under 35 U.S.C. 154(b) by 315 days.

(21) Appl. No.: 11/058,004

(22) Filed: Feb. 14, 2005

(65) Prior Publication Data

US 2006/0181215 A1 Aug. 17, 2006

(51) Int. Cl.
*H01J 17/18* (2006.01)

(52) U.S. Cl. ..... 313/625; 313/623; 313/624

(58) Field of Classification Search ..... 313/493, 313/623, 624, 625, 634
See application file for complete search history.

(56) References Cited

U.S. PATENT DOCUMENTS 1,640,226 A * 8/1927 Wheeler ..... 313/277
1,712,027 A * 5/1929 Cooke ..... 313/111
2,459,513 A * 1/1949 Flaws, Jr. ..... 65/139
4,970,425 A * 11/1990 Barakitis ..... 313/39

* cited by examiner

*Primary Examiner*—Vip Patel
(74) *Attorney, Agent, or Firm*—Curtis L. Harrington; Kathy E. Harrington; Harrington & Harrington

(57) ABSTRACT

A shaped bead structure provides a bottom sealing periphery adjacent a non-bonding portion which may include an upper portion which may provide upper envelope stability and may but will preferably not bond to the glass envelope. The provision of a section of the glass envelope free of bonding above the lower peripheral sealing provides a leveraged stability to the upper portion of the glass envelope, and provides an annular space to prevent vertical spreading of a wetted glass envelope sealing zone with respect to a significant length of the glass envelope leaving it in tact and enabling it to "break" any vertically extending wetted interface and thus disrupt distortion forces. The use of two or more structures to provide a significant annular area of non-contact with the annular envelope can help to provide a structure which is not complex and easy to manufacture. Where two of the bead sections are stacked with the portions which are displaced significantly peripherally inwardly adjacent each other, an annular space is formed.

12 Claims, 1 Drawing Sheet

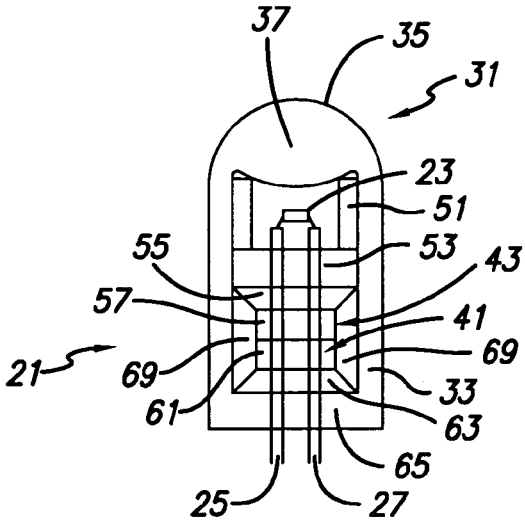
FIG. 1
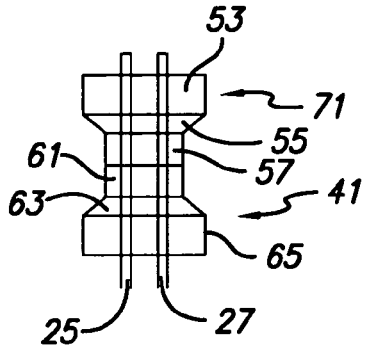
FIG. 2
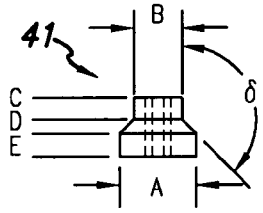
FIG. 3
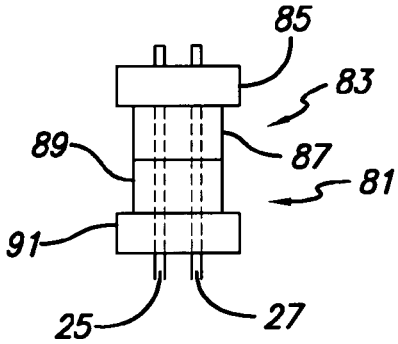
FIG. 4
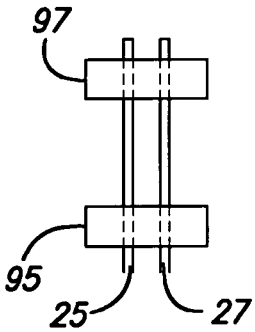
FIG. 5
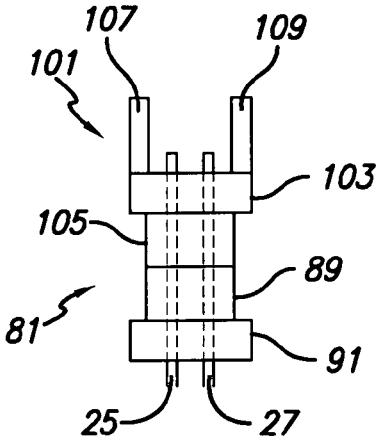
FIG. 6
FIG. 7
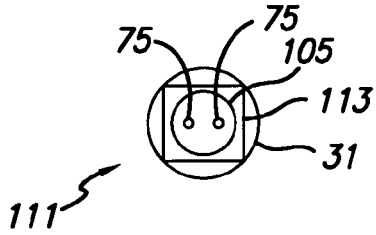

SPACER BEAD GEOMETRY FOR CONTROLLED SEALING STABILITY

FIELD OF THE INVENTION

The present invention relates to the field of high intensity, efficient incandescent lamps especially small bulbs in which an improved geometry spacer bead is employed to limit contact with the envelope to automatically improve the precision during the sealing phase of bulb manufacture.

BACKGROUND OF THE INVENTION

Achievement of quality control in small incandescent lamps is a goal of long standing. The small size of the envelope, the leads the filament, makes the assembly subject to forces on sealing that are out of proportion to the structural integrity resulting from the small size of the components.

In one well-known technique for constructing flashlight bulbs, a pressed and sintered glass bead was used in U.S. Pat. No. 4,618,799 which is incorporated herein by reference. The glass beads were tablet shaped with an outer periphery which was in close proximity to the inside of the glass envelope. Upon sealing, and especially in the usual case where one side of the envelope and bead stack achieved a higher temperature than the other side, sealing would begin vertically along the stack, and spread to the opposite side.

In inserting the stack, a small clearance was used between the stack and the envelope which was small enough to insure easy and repeatable insertion, but large enough that "wetted" or liquid-liquid contact would of necessity start at one point and proceed around the periphery of the stack to the opposite side. This one point "wetting" and circumferential progression occurs naturally, and the use of a stack of pill shaped beads provided some help in stabilizing against the distortive "pull" of the heated softened envelope in the direction of the initial wetted contact between the beads and the envelope.

In normal assembly, enough of a clearance has to be provided between the bead stack and the glass envelope so that the glass envelope will have easy clearance upon placement over the bead, two wire and filament stack. Further, there must be enough clearance such that no interference will occur on heating. In normal assembly, the assembled bulbs are located in a fixture and heated as a group.

The only way to avoid heating one side of the envelope more rapidly than the other side would be to provide a completely centered assembly which is heated circumferentially radially evenly. However, heating each bulb in this way would drive up the cost significantly. Envelope sealing is typically done in batches of lamps arranged into a two dimensional array. Heating is accomplished as rapidly as is practicable and of necessity not concentrically centered on each bulb. Even if such concentric heating were attempted, sealing will typically begin at the point about the periphery of the concentrically inward element with the outer glass envelope in closest proximity to the outer glass envelope.

Contact is followed by "wetted pulling" of the envelope about the concentrically inward sealing elements. The use of a stack of beads as in the U.S. Pat. No. 4,618,799 patent acted to prevent wetted, cohesive, one-sided pulling of the envelope by relying upon the size and volume occupied by the inner stack of beads in the hope that more often than not, there would be enough structural integrity in the beads to resist any lateral pulling of the envelope.

The lateral pulling of the envelope using a stack of pill shaped beads is most pronounced when the spread of the wetted contact proceeds vertically upward along one side of the stack of beads and combines to pull the envelope laterally to one side. This effect is most pronounced where the wetted contact proceeds to the vertically uppermost bead, as it can exert the most direct and uncompensated force on the upper portion of the glass envelope.

Although this effect can be ameliorated in instances where three or four opposing radial zones occur simultaneously, the probability of a single sided vertical spreading zone occurring is statistically significant enough to result in waste significant rejection of lamps during inspection. Any inexpensive mechanism which would result in reduction of the occurrence of this phenomenon would increase the overall quality of lamps produced and reduce scrap.

SUMMARY OF THE INVENTION

A shaped bead structure provides a bottom sealing periphery adjacent a non-bonding portion. An upper portion may provide upper envelope stability and may or may not bond to the glass envelope. Even where upper bonding occurs, the provision of a section of the glass envelope free of bonding above the lower peripheral sealing provides a leveraged stability to the upper portion of the glass envelope.

The technique and geometry provided by the shaped bead structure can work in conjunction with structures which provide spacing between the upper bead and glass envelope or between the filament and uppermost bead. The use of two or more structures to provide a significant annular area of non-contact with the annular envelope can help to provide a structure which is non-complex to manufacture. A bead section having a peripherally outermost portion and a portion which is displaced significantly peripherally inward to prevent contact with the glass envelope. Where two of the bead sections are stacked with the portions which are displaced significantly peripherally inwardly adjacent each other, an annular space is formed. The annular space prevents glass envelope sealing with respect to a significant length of the glass envelope leaving it in tact and enabling it to "break" any vertically extending wetted interface. Where only the bottom bead is used for sealing, the space provides a halt to any vertical growth of the wetted sealing, while the remainder of the bead structure within the glass envelope provides displacement of the fill gas. By providing fill gas displacement, the bulb becomes more efficient in requiring less fill gas and in concentrating the heat generated by the filament into a more confined area, by lowering the convection volume and effective radiative surface area exposed to convective gas.

The bead structure of the invention can be used in conjunction with glass envelopes having a lens-type end and can also work in conjunction with spacing structures and other ancillary structures. Further, where the bead structure geometry enables isolation of the wetted sealing bonding to a lower region within the glass envelope, the upper structure can be freed to be (1) a centering structure, (2) an alignment structure, or (3) eliminated. Upper bead structures are preferably non-sealing and preferably have limited contact with the inside of the glass envelope so that any inadvertent wetted bonding will not produce one sided pulling forces or will produce minimal pulling forces. Preferably any inadvertent minimal pulling forces will be balanced and will not cause a distortion.

BRIEF DESCRIPTION OF THE DRAWINGS

These and other aspects of the invention will be better understood from the following description in which reference is made to several drawings of which:

FIG. 1 is a plan view of one embodiment of a lamp employing a bead set with lower sealed bead within the glass envelope;

FIG. 2 is an isolated view of a pair of oppositely disposed beads with a pair of captured filament support legs;

FIG. 3 illustrates a pair of spaced apart beads supported by filament support legs;

FIG. 4 is a further embodiment illustrating a pair of beads in abutting position, each having a cylindrical structure and a reduced size cylindrical structure;

FIG. 5 is a further embodiment illustrating a pair of spaced apart beads each having a single cylindrical structure;

FIG. 6 is a plan view of a pair of beads including a lower bead structure as seen in FIG. 5 and an upper bead structure having a pair of upwardly extending projection structures; and FIG. 7 is a bottom view of a bead having a reduced size cylindrical structure underlying a square plate shown abutting the inside of a glass envelope at the corners of the square plate.

DETAILED DESCRIPTION OF THE PREFERRED EMBODIMENT

FIG. 1 is a plan view of a small incandescent lamp 21 of a well known construction, typically used for high intensity lamp applications. The lamp 21 includes a filament 23 that is attached at either of its ends to filament support legs 25 and 27 which are spaced apart conductors, typically 0.010 Dumet wire for small lamp applications. A glass envelope 31 has generally cylindrical side walls 33 and an end portion 35. End portion 35 has an optionally internally thickened portion 37 acting as a lens 37.

Internal structures in and around the filament support legs 25 and 27 and filament 23 may be seen as separate or as blended into the surrounding glass envelope 31 or into each other depending upon the level of processing. Some dividing lines are shown for purposes of discussion and to emphasize starting materials, but any combination of materials, once processed may lose their separate nature.

A lower bead structure 41 is shown having a line of separation with respect to an upper bead structure 43, but lower bead structure 41 is seen as continuous with the lower portion of the cylindrical side walls 33. In FIG. 1, upper bead structure 43 was stacked atop lower bead structure 41 and fused and sealed about filament support legs 25 and 27.

The upper bead structure 43 has an optional upper wall structure 51 which can be used to set the spacing of the upper bead structure 43 with respect to the upper inside surface of the glass envelope 31. The upper bead structure 43 has a cylindrical structure 53 which supports the upper wall structure 51. Below the cylindrical structure 53, an optional frusto-conical portion 55 leads to a reduced size cylindrical structure 57.

A line shows the separation between the reduced size cylindrical structure 57 of upper bead structure 42 and a reduced size cylindrical structure 61 of lower bead structure 41. From the reduced size cylindrical structure 61 of lower bead structure 41, a frusto conical transition structure 63 transitions into a cylindrical structure 65 which is shown as integrally fused with the generally cylindrical side walls 33 of glass envelope 31.

The noteworthy feature or contribution of the lower bead structure 41 and upper bead structure 43 is that they combine to create an annular space 69 due to the structures including frusto-conical portion 55, reduced size cylindrical structure 57, reduced sized cylindrical structure 61, and frusto-conical transition structure 63. The specific shape of these structures is less important than the fact that they provide enough of a separation with respect to the cylindrical side walls 33 of glass envelope 31 to maintain the annular space 69 after thermal fusion occurs, and thus prevent the fusion blending from going higher than the matched cylindrical outer extent of the cylindrical structure 65.

Further, the unitary or adjacent stacking of the structures which maintain the annular space 69 is similarly unimportant to the functioning of the structures. Here, lower bead structure 41 and upper bead structure 43 together have an hourglass shape. A single structure could have been provided which included a single piece having the shape of both the lower bead structure 41 and upper bead structure 43 combined. FIG. 1 shows fusion of the glass envelope 31 at the bottom most cylindrical structure 65, but not along the periphery of optional upper wall structure 51 and cylindrical structure 53. This could be achieved either by heating the bottom of the lamp 21 at a higher rate than the top, or by setting the external diameter of the optional upper wall structure 51 and cylindrical structure 53 to give enough clearance that wetted bonding would not occur. It may be more preferable that upper bonding not occur as wetted bonding and pulling forces occurring nearer the tip end of the lamp can potentially produce more severe distortion.

Referring to FIG. 2, an upper bead structure 71 is seen without the optional upper wall structure 51 seen in FIG. 1, and mounted over the same lower bead structure 41 seen in FIG. 1, but depicted before sealing. The structural attributes, including cylindrical structure 53 optional frusto conical portion 55, reduced size cylindrical structure 57, reduced sized cylindrical structure 61, frusto conical transition structure 63, and cylindrical structure 65 are essentially the same as was seen in FIG. 1 except that the cylindrical structure 65 in FIG. 1 was shown in a bonded state with respect to the glass envelope 31.

The upper bead structure 71 may have the same dimensions as the lower bead structure 41, or it may preferably be smaller. The upper bead structure 71 may include a geometry which is resistant to bonding with the glass envelope 31. The configuration of FIG. 2 illustrates two substantially identical beads 71 and 41 in an opposing relationship and which are bonded about the filament support legs 25 and 27. In the usual manufacturing process, the filament support legs 25 and 27 may be oriented to be captured during a sintering process.

The orientation of FIG. 2 shows two beads with their relatively smaller diameter portions opposed to create a longer length annular space 69 within the glass envelope 31. The upper bead structure 71 could be reversed to form a shorter and perhaps periodically occurring annular space 69 along the length of the glass envelope, particularly if a stack of beads were used. Each relatively smaller annular space 69 formed would provide an additional barrier to vertical travel of the wetted molecular bonding interface and thus prevent a predominant pulling of the glass envelope 31 to one side. Any orientation which breaks up or inhibits the ability for a vertically propagating zone to pull the glass envelope 31 off center provides an advantage.

In forming the structure of FIG. 2, filament support legs 25 and 27 may be provided in a fixture with the upper and lower bead structures 71 and 41 loaded on. The upper and lower bead structures 71 and 41 can be heated, sintered, pressured and generally sealed with respect to the filament support legs 25 and 27. The filament 23 can then be welded between the upper ends of the filament support legs 25 and 27 to prepare for loading within the glass envelope 31.

The geometry for the upper and lower bead structures 71 and 41 may be similar. Lower bead structure 41 will be discussed with equal applicability to upper bead structure 71. The main features of bead structure 41 is a circumferentially outward cylindrical structure 65 and a circumferentially inward or reduced size cylindrical structure 61. The frusto conical transition structure 63 may appear to provide a more natural transition between cylindrical structures 65 and 61.

Referring to FIG. 3, the bead structure 41 for a small lamp having a diameter of about 0.17 inches may have an outer diameter "A" of cylindrical structure 65 of about 0.127 inches, and a diameter "B" of the reduced size cylindrical structure 61 of about 0.080 inches. The angle of the frusto conical transition structure 63 with respect to the axis "δ" may have a value of about 135°.

The axial height of the reduced size cylindrical structure 61 may be about 0.030 inches, the height of the frusto conical transition structure 63 may be about 0.033 inches and the axial height of the cylindrical structure 65 may be about 0.040 inches. Thus the non sealing percentage of height of the lower bead structure may be about 61% of the overall height.

Instead of using two opposed beads, a single bead can be used, especially where the height of the reduced size cylindrical structure 61 may be about 0.130 inches. In this case, the diameter of the reduced size cylindrical structure 61 may be increased for enhanced gas displacement to a diameter of from about 0.080 inches to about 0.11 inches. In this case, the diameter can be varied to insure that there is no statistically significant amount of wetted sealing between the bead structure 41 and the glass envelope 31.

A pair of bores may be pre-formed before insertion of the filament support legs 25 and 27. Where the filament support legs 25 and 27 are made of 0.010 inch wire, the holes may be made to a diameter of between 0.012 to 0.014 inches to enable the provision of an adequate seal.

Referring to FIG. 4 rather more abrupt transition is seen in the two bead stack shown including a lower bead structure 81 is shown having a line of separation with respect to an upper bead structure 83. As before, the lower bead structure 81 need not be stacked to oppose the upper bead structure 83, and the combined geometry of a spool shaped structure seen in FIG. 4 could be made as a one piece structure.

The upper bead structure 83 has an upper cylindrical structure 85 overlying a reduced size cylindrical structure 87. Likewise, lower bead structure 83 has a reduced size cylindrical structure 89 overlying a cylindrical structure 91. The upper bead structure 83 upper cylindrical structure 85 may preferably be of less diameter than the cylindrical structure 91. As in the earlier alternative, the lower bead structure 81 can be used singly, with a taller reduced size cylindrical structure 89.

Referring to FIG. 5, a lower bead 95 is seen as having a cylindrical shape. An upper bead 97 is seen spaced apart from the lower bead, and may have a smaller diameter or other surface features which resist wetted bonding sealing to the internal periphery of the glass envelope 31. In the configuration of FIG. 5, the stiffness of the filament support legs 25 and 27 are effectively utilized to support the upper bead 97 and guidably center the filament 23 which will be attached at the top of the filament support legs 25 and 27 with respect to the glass envelope 31. The lower bead 95 will be used to seal the bottom of the glass envelope 31.

Referring to FIG. 6, another specialized top bead is shown in conjunction with the bottom bead 81 seen in FIG. 4. An upper bead 101 has a cylindrical structure 103 and a reduced size cylindrical structure 105 in opposition to reduced size cylindrical structure 89 of lower bead 18. However, rather than support an annular cylindrical or upper wall structure 51 as seen in FIG. 1, the cylindrical structure 103 supports a plurality of projections, including a projection 107 and a projection 109. The projections 107 and 109 help to limit wetted bonding by preventing travel of the wetted zone circumferentially around the inside of the glass envelope 31. To the extent that any wetting bonding extends vertically along the projections 107 and 109, such will have extremely limited distortion ability as the common wetted bonding areas will be extremely brief as compared to the circumferential outward periphery of a structure like cylindrical structure 91. Thus any wetting which inadvertently occurs cannot develop the large area force which would be associated with circumferential spreading.

A bottom view of a further embodiment of an upper bead 111 us seen in FIG. 7. A square plate 113 is sized to fit within the glass envelope 31 with contact with the inside of the glass envelope 31 only at the corners of the square plate 113. The square plate is supported by a reduced size cylindrical structure 105 which has a significant clearance with respect to the inside of the glass envelope 31 to insure that no wetted bonding can occur between the reduced size cylindrical structure 105 and the glass envelope 31. A pair of bores 75 to accommodate filament support legs 25 and 27 are shown.

A great number of variations on the embodiment shown are possible and are likely to occur to workers and technicians in this field. These variations are considered to be comprehended by the present invention which is limited only by the following claims.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed:

1. An electric lamp comprising:

a transparent envelope;

at least one conductor;

a button shaped bead surrounding said at least one conductor and having a cylindrical structure for providing wetted sealing with respect to the envelope at least partially surrounding said bead, a reduced size cylindrical structure depending from said cylindrical structure, said bead creating a space between said reduced size cylindrical structure and an inside surface of the glass envelope; and a filament attached to said at least one conductor.

2. The electric lamp as recited in claim 1 and further comprising at least two beads, and including a first bead for sealed with respect to said transparent envelope and a second bead not sealed with respect to said transparent envelope, said first and said second beads abutting each other within said transparent envelope.

3. The electric lamp as recited in claim 2 wherein said at least two beads abut and are oppositely oriented with respect to each other.

4. The electric lamp as recited in claim 1 and wherein said bead further includes an angled transition structure between said cylindrical structure for providing wetted sealing and said reduced size cylindrical structure.

5. The electric lamp as recited in claim 1 and wherein said cylindrical structure for providing wetted sealing is less than about 65% of an axial length of said bead.

6. The electric lamp as recited in claim 1 and wherein said at least one conductor is a pair of spaced apart conductors and wherein said filament is connected between said pair of spaced apart conductors.

7. An electric lamp comprising:

a transparent envelope;

at least one conductor;

a button shaped bead surrounding said at least one conductor and having a first cylindrical structure for providing wetted sealing with respect to the envelope upon heating of the envelope, said bead having a second structure depending from said first cylindrical structure, for preventing wetted contact between said second structure and said envelope upon heating of the envelope; and a filament attached to said at least one conductor.

8. The electric lamp as recited in claim 7 and further comprising at least two beads, and including a first bead for sealed with respect to said transparent envelope and a second bead not sealed with respect to said transparent envelope, said first and said second beads abutting each other within the envelope.

9. The electric lamp as recited in claim 8 wherein said at least two beads abut and are oppositely oriented with respect to each other.

10. The electric lamp as recited in claim 7 and wherein said bead further includes an angled transition structure between said first cylindrical structure for providing wetted sealing and said second structure.

11. The electric lamp as recited in claim 7 and wherein said first cylindrical structure for providing wetted sealing is less than about 65% of an axial length of said bead.

12. The electric lamp as recited in claim 7 and wherein said at least one conductor is a pair of spaced apart conductors and wherein said filament is connected betweens said pair of spaced apart conductors.

* * * * *